US012134811B2

(12) United States Patent
Kim et al.

(10) Patent No.: US 12,134,811 B2
(45) Date of Patent: Nov. 5, 2024

(54) HIGH-STRENGTH HOT-ROLLED STEEL SHEET HAVING EXCELLENT BENDABILITY AND LOW-TEMPERATURE AND METHOD FOR MANUFACTURING SAME

(71) Applicant: POSCO CO., LTD, Pohang-si (KR)

(72) Inventors: Sung-Il Kim, Gwangyang-si (KR); Hee-Sung Kang, Gwangyang-si (KR); Hyun-Seok Tak, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/213,539

(22) Filed: Jun. 23, 2023

(65) Prior Publication Data

US 2023/0332281 A1 Oct. 19, 2023

Related U.S. Application Data

(62) Division of application No. 16/772,931, filed as application No. PCT/KR2018/014462 on Nov. 22, 2018, now Pat. No. 11,732,339.

(30) Foreign Application Priority Data

Dec. 22, 2017 (KR) ..... 10-2017-0178826

(51) Int. Cl.
*C22C 38/22* (2006.01)
*C21D 8/02* (2006.01)
(Continued)

(52) U.S. Cl.
CPC ..... *C22C 38/22* (2013.01); *C21D 8/0226* (2013.01); *C21D 8/0257* (2013.01); *C21D 9/46* (2013.01);
(Continued)

(58) Field of Classification Search
CPC ..... C21D 2211/001; C21D 2211/002; C21D 2211/005; C21D 2211/008; C21D 8/0226;
(Continued)

(56) References Cited

U.S. PATENT DOCUMENTS 7,699,947 B2 4/2010 Seux et al.
7,833,363 B2 11/2010 Keda et al.
(Continued)

FOREIGN PATENT DOCUMENTS

CN 101962741 A 2/2011
EP 1375694 A1 1/2004
(Continued)

OTHER PUBLICATIONS

International Search Report dated Feb. 22, 2019 issued in International Patent Application No. PCT/KR2018/014462 (along with English translation).
(Continued)

*Primary Examiner* — Jie Yang
(74) *Attorney, Agent, or Firm* — Morgan, Lewis & Bockius LLP

(57) ABSTRACT

The present disclosure relates to a hot-rolled steel sheet utilized as material for heavy machinery, vehicle frames, and the like, and more specifically to a high-strength hot-rolled steel sheet having excellent bendability and low-temperature toughness and a method for manufacturing same.

3 Claims, 1 Drawing Sheet

(51) Int. Cl.
*C21D 9/46* (2006.01)
*C22C 38/04* (2006.01)

(52) U.S. Cl.
CPC ..... *C22C 38/04* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0257; C21D 9/46; C22C 38/02; C22C 38/04; C22C 38/22; C22C 38/24; C22C 38/26; C22C 38/28; C22C 38/32
See application file for complete search history.

(56) References Cited

U.S. PATENT DOCUMENTS

| | | | | |
|---|---|---|---|---|
| 10,837,079 | B2 * | 11/2020 | Liimatainen ..... | C21D 9/46 |
| 2004/0074575 | A1 | 4/2004 | Kashima | |
| 2013/0048151 | A1 | 2/2013 | Kawamura et al. | |
| 2013/0146180 | A1 | 6/2013 | Kubota | |
| 2014/0377584 | A1 | 12/2014 | Hasegawa | |
| 2015/0047751 | A1 | 2/2015 | Ono et al. | |
| 2016/0060723 | A1 | 3/2016 | Yamazaki et al. | |
| 2016/0333440 | A1 | 11/2016 | Liimatainen et al. | |
| 2017/0218475 | A1 | 8/2017 | Kawasaki et al. | |
| 2017/0349987 | A1 | 12/2017 | Liu et al. | |
| 2020/0385840 | A1 | 12/2020 | Kim | |

FOREIGN PATENT DOCUMENTS

| | | | |
|---|---|---|---|
| IN | 297154 | | 1/2014 |
| JP | 2008-088485 | A | 4/2008 |
| JP | 2009242840 | A | 10/2009 |
| JP | 2010-196163 | A | 9/2010 |
| JP | 2011-179030 | A | 9/2011 |
| JP | 2014-037589 | A | 2/2014 |
| JP | 2014-218692 | A | 11/2014 |
| JP | 2015-190015 | A | 11/2015 |
| KR | 10-2012-0101596 | A | 9/2012 |
| KR | 10-2013-0046942 | A | 5/2013 |
| KR | 10-2014-0068206 | A | 6/2014 |
| KR | 10-2015-0007609 | A | 1/2015 |
| KR | 10-2015-0119363 | A | 10/2015 |
| KR | 10-2016-0079165 | A | 7/2016 |
| KR | 10-2017-0086099 | A | 7/2017 |
| WO | 2011/142285 | A1 | 11/2011 |
| WO | 2012/072884 | A9 | 6/2012 |
| WO | 2012/108460 | A1 | 8/2012 |
| WO | 2016021195 | A1 | 11/2016 |

OTHER PUBLICATIONS

U.S. Notice of Allowance dated Apr. 3, 2023 issued in U.S. Appl. No. 16/772,931.
U.S. Non-Final Office Action dated Dec. 21, 2022 issued in U.S. Appl. No. 16/772,931.
U.S. Final Office Action dated Jul. 27, 2022 issued in U.S. Appl. No. 16/772,931.
U.S. Non-Final Office Action dated Apr. 4, 2022 issued in U.S. Appl. No. 16/772,931.
Online translation of WO 2011/142285A1, dated Nov. 2011.
Chinese Office Action dated Mar. 19, 2021 issued in Chinese Patent Application No. 201880074405.6.
Extended European Search Report dated Nov. 3, 2020 issued in European Patent Application No. 18890351.2.

* cited by examiner

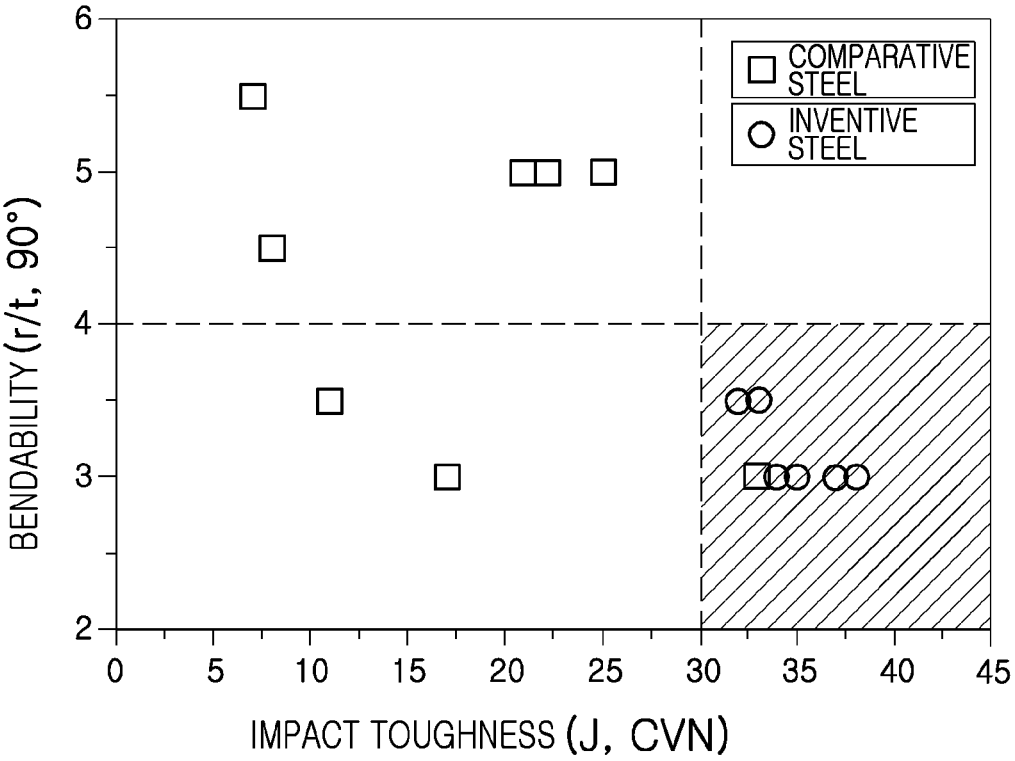
COMPARATIVE STEEL
INVENTIVE STEEL
BENDABILITY (r/t, 90°)
IMPACT TOUGHNESS (J, CVN)
6
5
4
3
2
0
5
10
15
20
25
30
35
40
45

HIGH-STRENGTH HOT-ROLLED STEEL SHEET HAVING EXCELLENT BENDABILITY AND LOW-TEMPERATURE AND METHOD FOR MANUFACTURING SAME

CROSS-REFERENCE OF RELATED APPLICATIONS

This application is a divisional patent application of U.S. patent application Ser. No. 16/772,931, filed on Jun. 15, 2020 which is the U.S. National Phase under 35 U.S.C. § 371 of International Patent Application No. PCT/KR2018/014462, filed on Nov. 22, 2018, which in turn claims the benefit of Korean Application No. 10-2017-0178826, filed on Dec. 22, 2017, the entire disclosures of which applications are incorporated by reference herein.

TECHNICAL FIELD

The present disclosure relates to a hot-rolled steel sheet used as a material in heavy machinery, commercial vehicles, or the like, and more particularly, to a high-strength hot-rolled steel sheet having excellent bendability and low-temperature toughness and a method for manufacturing same.

BACKGROUND ART

Conventionally, a hot-rolled steel sheet used as a material for a boom arm of heavy machinery utilizes alloying elements such as copper (Cu), nickel (Ni), molybdenum (Mo), Niobium (Nb), titanium (Ti), and the like, to improve weldability and impact resistance, and is cooled to room temperature at a high cooling rate to be manufactured as high-strength steel having a martensite phase as a matrix structure. Alternatively, in order to improve bendability and impact resistance, the hot-rolled steel sheet is manufactured to have a bainite phase as a matrix structure.

As an example, in Patent Document 1, Cu, Ni, and Mo are added to secure impact resistance and weldability while securing yield strength of 960 MPa or more. By adding a large amount of alloying elements, hardenability is improved to easily secure high strength, but it may be difficult to improve bendability and manufacturing costs may be increased.

In Patent Document 2, when manufacturing a thick hot-rolled steel sheet, physical properties of a thick steel sheet are intended to be improved by adding an appropriate amount of Ti, Nb, and the like, and controlling cooling rates of a surface layer portion and a deep layer portion such that microstructures of the surface layer portion and the deep layer portion are formed to be different from each other. However, there may be a limitation in applying this patent to a thin steel sheet.

In Patent Document 3, alloying elements such as Mn, Cr, Ni, and Mo in a specific range are proposed to low-carbon steel to obtain a bainite matrix structure, and a high yield ratio and an improvement in bendability are intended to be achieved. However, in this case, a large amount of alloying elements may be required to secure a stable bainite structure, it may be difficult to control a cooling stop temperature, there may be high possibility of deviations that a material, bendability, or the like, and deterioration of shape quality.

In Patent 4, an alloying element is limited to a specific range to produce a microstructure of a hot-rolled steel sheet with bainite-martensite, and a coiling temperature is controlled to 400° C. or less, or 250° C. or less. Even in this case, it may be difficult to control an accurate coiling temperature through cooling after hot rolling and shape quality may be deteriorated.

(Patent Document 1) European Patent Publication No. 2646582

(Patent Document 2) Japanese Laid-Open Patent Publication No. 2010-196163

(Patent Document 3) U.S. Patent Publication No. 2016-0333440

(Patent Document 4) U.S. Patent Registration No. 7699947

DISCLOSURE

Technical Problem

An aspect of the present disclosure is to provide a hot-rolled steel sheet having high-strength while having excellent bending formability and impact resistance in a low-temperature region, and a method for manufacturing the same.

Technical Solution

According to an aspect of the present disclosure, a high-strength hot-rolled steel sheet having excellent bendability and low-temperature toughness, includes, by weight percentage (wt %), C: 0.05 to 0.15%, Si: 0.01 to 0.5%, Mn: 0.8 to 1.5%, Al: 0.01 to 0.1%, Cr: 0.3 to 1.2%, Mo: 0.001 to 0.5%, P: 0.001 to 0.01%, S: 0.001 to 0.01%, N: 0.001 to 0.01%, Nb: 0.001 to 0.06%, Ti: 0.005 to 0.03%, V: 0.001 to 0.2%, B: 0.0003 to 0.003%, a remainder of iron (Fe), and other unavoidable impurities. A content relationship (T) of C, Mn, Cr, and Mo, expressed by Relational Expression 1 below, satisfies 1.0 to 2.5. A microstructure of a surface layer region (a region from a surface layer to a t/9 point (where t denotes a thickness (mm)) in a thickness direction includes a ferrite and tempered bainite composite structure having an area fraction of 15% or more, at least one of retained austenite and tempered martensite. A central region excluding the surface layer portion includes tempered martensite having an area fraction of 80% or more, and at least one of retained austenite, bainite, tempered bainite, and ferrite, $$T=[C]+\{[Mn]/(0.85[Cr]+1.3[Mo])\} \quad \text{Relational Expression 1}$$

where C, Mn, Cr, and Mo refer to weight contents of elements, respectively.

According to another aspect of the present disclosure, a method for manufacturing a high-strength hot-rolled steel sheet having excellent bendability and low-temperature toughness includes reheating a steel slab, satisfying the above-described alloying composition and the above-described Relational Expression 1, to a temperature within a range of 1200° C. to 1350° C., finish hot rolling the reheated steel slab to a temperature within a range of 850° C. to 1150° C. to manufacture a hot-rolled steel sheet, cooling the hot-rolled steel sheet to a temperature within a range of 500° C. to 700° C. at a cooling rate of 10° C./s to 70° C./s after the finish hot rolling, coiling the hot-rolled steel sheet within a temperature range of 500° C. to 700° C. after the cooling, performing a first heat treatment to preserve heat of the hot-rolled steel sheet or to heat the hot-rolled steel sheet within a temperature range of 350° C. to 500° C. after the coiling, performing first cooling to cool the hot-rolled steel sheet to a room temperature at a cooling rate of 0.001° C./s to 10° C./s after the first heat treatment, performing a second heat treatment to reheat the hot-rolled steel sheet to a temperature within a range of 850° C. to 1000° C. and to maintain the reheated hot-rolled steel sheet for 10 minutes to 60 minutes after the first cooling, performing second cooling to cool the hot-rolled steel sheet to a temperature within a range of 0° C. to 100° C. at a cooling rate of 10° C./s to 100° C./s after the second heat treatment, performing a third heat treatment to reheat the hot-rolled steel sheet to a temperature within a range of 100° C. to 500° C. and to thermally treat the reheated hot-rolled steel sheet for 10 minutes to 60 minutes after the second cooling, and performing third cooling to cool the hot-rolled steel sheet to a temperature within a range of 0° C. to 100° C. at a cooling rate of 0.001° C./s to 100° C./s after the third heat treatment.

Advantageous Effects

According to the present disclosure, a hot-rolled steel sheet having a small thickness-dependent hardness deviation and excellent bendability and low-temperature toughness.

In particular, a hot-rolled steel sheet according to the present disclosure may have yield strength of 900 MPa or more and may secure Charpy impact energy of 30 J or more at a temperature of −60° C. and a bendability index (R/t) of 4 or less.

DESCRIPTION OF DRAWINGS

FIG. 1 is a graph showing a relationship between impact toughness in a low-temperature region and bendability of Inventive Steels according to an example embodiment of the present disclosure and Comparative Steels.

BEST MODE FOR INVENTION

The present inventors have conducted intensive research to develop a hot-rolled steel sheet having physical properties, appropriately used as a material of heavy machinery, commercial vehicles, or the like, in particular, excellent bendability and low-temperature toughness and small variation in mechanical properties.

As a result, it has been found that thickness-dependent hardness of a steel sheet may be controlled by optimizing an alloying composition and manufacturing conditions, and a high-strength hot-rolled steel sheet having a structure advantageous in obtaining intended physical properties may be manufactured, thereby completing the present disclosure.

In particular, a technical significance of the present disclosure is to reduce hardness of a surface layer portion, as compared with a central portion, by forming a structure of the surface layer portion as a soft phase through more decarburization occurring in the surface layer portion, as compared with the central portion, based on a thickness direction of a steel sheet.

Hereinafter, the present disclosure will be described in detail.

A high-strength hot-rolled steel sheet having excellent bendability and low-temperature toughness according to an aspect of the present disclosure includes, by weight percentage (wt %), in detail, C: 0.05 to 0.15%, Si: 0.01 to 0.5%, Mn: 0.8 to 1.5%, Al: 0.01 to 0.1%, Cr: 0.3 to 1.2%, Mo: 0.001 to 0.5%, P: 0.001 to 0.01%, S: 0.001 to 0.01%, N: 0.001 to 0.01%, Nb: 0.001 to 0.06%, Ti: 0.005 to 0.03%, V: 0.001 to 0.2%, and B: 0.0003 to 0.003%.

Hereinafter, reasons for controlling alloying components of the high-strength hot-rolled steel sheet provided by the present disclosure will be described in detail. In this case, unless otherwise specified, the content of each component means weight percentage (wt %).

C: 0.05 to 0.15%

Carbon (C) is an element effective to strengthen steel. As the content of C is increased, a fraction of a martensite or bainite phase is increased to improve tensile strength.

When the content of C is less than 0.05%, it is difficult to sufficiently obtain a strengthening effect of steel. Meanwhile, when the content of C is greater than 0.15%, coarse carbides and precipitates are excessively formed during heat treatment process to deteriorate formability and impact resistance in a low-temperature region and to result in poor weldability.

Therefore, in the present disclosure, the content of C is controlled to, in detail, 0.05 to 0.15%. More advantageously, the content of C may be controlled to 0.07 to 0.13%.

Si: 0.01 to 0.5%

Silicon (Si) serves to deoxidize molten steel and is effective in solid solution strengthening to improve strength. In addition, Si retards formation of coarse carbide to be effective in improving formability and impact resistance of a steel sheet.

When the content of Si is less than 0.01%, there is little effect in retarding formation of carbide, and thus, an improvement in formability and impact resistance is insufficient. Meanwhile, when the content of Si is greater than 0.5%, a red scale is formed on a surface of a steel sheet by Si during hot rolling to significantly deteriorate surface quality of the steel sheet and to result in poor weldability. Therefore, in the present disclosure, the content of Si is controlled to, in detail, 0.01 to 0.5%. The content of Si may be controlled to, in further detail, 0.05 to 0.4%.

Mn: 0.8 to 1.5%

Manganese (Mn) is an element effective in solid solution strengthening, similarly to Si. In addition, Mn increases hardenability of steel to easily form a martensite phase and a bainite phase during a cooling process after a heat treatment.

To sufficiently obtain the above effect, the content of Mn is, in detail, 0.8% or more. However, the content of Mn is greater than 1.5%, a segregation part significantly develops in a thickness center portion of a slab during casting of the slab in a continuous casting process and anon-uniform structure is formed in a thickness direction during a cooling process after a heat treatment to deteriorate impact resistance in a low-temperature region.

Therefore, in the present disclosure, the content of Mn is controlled to, in detail, 0.8 to 1.5%. More advantageously, the content of Mn may be controlled to, in detail, 1.0 to 1.5%.

Al: 0.01 to 0.1%

Aluminum (Al) is an element added mainly for deoxidation. When the content of Al is less than 0.01%, a deoxidation effect may not be sufficiently obtained. Meanwhile, when the content of Al is greater than 0.1%, Al binds with nitrogen to an AlN precipitate, and thus, corner cracking is likely to occur in the slab during continuous casting and defects caused by formation of inclusions are likely to occur.

Therefore, in the present disclosure, the content of Al is controlled to, in detail, 0.01 to 0.1%.

Cr: 0.3 to 1.2%

Chromium (Cr) contributes to solid-solution strengthening of steel and serves to retard ferrite phase transformation during cooling to help form a martensite phase and a bainite phase.

To sufficiently obtain the above effect, it is necessary to add Cr in a content of 0.3% or more. However, when the content of Cr is greater than 1.2%, similarly to Mn, a segregation part significantly develops in the thickness center portion of the slab and a non-uniform structure is formed in the thickness direction to deteriorate impact resistance in a low-temperature region.

Therefore, in the present disclosure, the content of Cr is controlled to, in detail, 0.3 to 1.2%. Advantageously, the content of Cr is controlled to, in further detail, 0.5 to 1.0%.

Mo: 0.001 to 0.5%

Molybdenum (Mo) increases hardenability of the steel to facilitate the formation of the martensite phase and the bainite phase.

When the content of Mo is less than 0.001%, the above effect may not be sufficiently obtained. When the content of Mo is greater than 0.5%, precipitates formed during coiling immediately after hot rolling are coarsely grown during the heat treatment to deteriorate the impact resistance in a low-temperature region. In addition, when the content of Mo is excessive with an expensive element, it is economically disadvantageous and also disadvantageous to weldability.

Therefore, in the present disclosure, the content of Mo is controlled to, in detail, 0.001 to 0.5%. More advantageously, the content of Mo is controlled to, in detail, 0.01 to 0.3%.

P: 0.001 to 0.01%

Phosphorus (P) has a high solid solution strengthening effect, but may cause brittleness due to grain boundary segregation, which may result in poor impact resistance.

In view of the above, the content of P is controlled to, in detail, 0.01% or less. However, the manufacturing costs may be excessively incurred to control the content of P to less than 0.001%, which is economically disadvantageous.

Therefore, in the present disclosure, the content of P is controlled to, in detail, 0.001 to 0.01%.

S: 0.001 to 0.01%

Sulfur (S) is an impurity present in the steel. When the content of S is greater than 0.01%, S binds with Mn, or the like, to form a nonmetallic inclusion. Thus, fine cracking is likely to occur during a steel cutting process and impact resistance is significantly lowered.

To control the content of S to less than 0.001%, a significantly long time is required in a steelmaking operation to lower productivity.

Therefore, in the present disclosure, the content of S is controlled to, in detail, 0.001 to 0.01%.

N: 0.001 to 0.01%

Nitrogen (N) is a solid solution strengthening element and binds with Ti or Al to form a coarse precipitate. The solid solution strengthening effect of N is better than that of carbon, but toughness is significantly lowered as the amount of N in the steel is increased.

In consideration of the above, the content of N is controlled to, in detail, 0.01% or less. However, to control the content of N to less than 0.001%, a significantly long time is required in a steelmaking operation to lower productivity.

Therefore, in the present disclosure, the content of N is controlled to, in detail, 0.001 to 0.01%.

Nb: 0.001 to 0.06%

Niobium (Nb) is a representative precipitation strengthening element, in addition to titanium (Ti) and vanadium (V). Specifically, a precipitate is formed in the form of a carbide, a nitride, or a carbonitride during hot rolling to exhibit a grain refinement effect by retardation of recrystallization, and thus, the strength and impact toughness of steel are effectively improved.

To sufficiently obtain the above effect, Nb is added in an amount of, in detail, 0.001% or more. However, when the content of Nb is greater than 0.06%, Nb is grown as a coarse precipitate during the heat treatment to deteriorate the impact resistance in the low-temperature region.

Therefore, in the present disclosure, the content of Nb is controlled to, in detail, 0.001 to 0.06%.

Ti: 0.005 to 0.03%

Titanium (Ti) is a representative precipitation strengthening element, in addition to Nb and V. In particular, Ti forms TiN in the steel due to strong affinity with N. A TiN precipitate has an effect of inhibiting grains from growing during a heating process for hot rolling. Due to the formation of TiN, solid-solubilized N is stabilized to prevent B, added to improve hardenability, from being consumed as BN. Thus, B is advantageously utilized. Ti, remaining after reacting with N, binds with C such that a TiC precipitate is formed to improve the strength of the steel.

To sufficiently obtain the above effect, Ti is added in an amount of 0.005% or more. However, when the content of Ti is greater than 0.03%, coarse TiN is formed and coarseness of the precipitate during a heat treatment to deteriorate the impact resistance in the low-temperature region.

Therefore, in the present disclosure, the content of Ti is controlled to, in detail, 0.005 to 0.03%.

V: 0.001 to 0.2%

Vanadium (V) is a representative precipitation strengthening element, in addition to Nb and Ti. V is effective in improving the strength of steel by forming a precipitate after coiling.

To obtain the above effect, V is added in an amount of, in detail, 0.001% or more. When the content of V is greater than 0.2%, a coarse composite precipitate is formed to deteriorate impact resistance in a low-temperature region and to result in an economical disadvantage.

Therefore, in the present disclosure, the content of V is controlled to, in detail, 0.001 to 0.2%.

B: 0.0003 to 0.003%

Boron (B) has an effect of improving hardenability when B is in a solid-solubilized state in steel, and has an effect of stabilizing the grain boundaries to improve brittleness of the steel in a low-temperature region.

To sufficiently obtain the above effect, B is added in an amount of, in detail, 0.0003% or more. However, when the content of B is greater than 0.003%, a recrystallization behavior is retarded during hot rolling, and hardenability is excessively increased to result in poor formability.

Therefore, in the present disclosure, the content of B is controlled to, in detail, 0.0003 to 0.003%.

In the present disclosure, a component relationship of C, Mn, Cr, and Mo controlled by the above-described composition ranges is expressed by Relational Expression 1, and a value T thereof is preferably satisfies 1.0 to 2.5.

$$T=[C]+\{[Mn]/(0.85[Cr]+1.3[Mo])\} \quad \text{Relational Expression 1}$$

where C, Mn, Cr, and Mo refer to weight contents of elements, respectively.

Relational Expression 1 is given to significantly reduce a difference in microstructure and material depending on a thickness direction due to segregation of Mn, Cr, and the like, formed mainly in a thickness center portion of the steel sheet.

In the present disclosure, the higher the contents of C, Mn, Cr and Mo, the greater the hardenability of the microstructure of the steel, and thus, a martensite phase is easily formed even at a lower cooling rate, which is advantageous in securing strength. However, C, Mn, Cr, and Mo are locally segregated in the thickness center portion of the steel sheet to cause the microstructure in the center portion to be non-uniform. Accordingly, as a microstructure and a material of a surface layer portion vary, bending formability and impact resistance in a low-temperature region are deteriorated. Therefore, an effect of segregation needs to be reduced.

To this end, in the present disclosure, the content of Mn is decreased and, instead, Cr and Mo are added to reduce a material difference depending on a thickness of the steel sheet and to improve bending formability and impact resistance in a low-temperature region. However, since Cr and Mo are expensive elements and the same segregation occurs when Cr and Mo are excessively contained, the contents of C, Mn, Cr and Mo are controlled by Relational Expression 1.

Specifically, when a value of Relational Expression 1 is less than 1.0, the contents of Cr and Mo are excessive, and the bendability and the impact resistance in the low-temperature region are deteriorated by segregation to result in economical disadvantage. On the other hand, when the value of Relational Expression 1 is greater than 2.5, centerline segregation of Mn and C is increased to deteriorate the bendability and the impact resistance in the low-temperature region.

The remainder of the present disclosure may be iron (Fe). In the conventional steel producing process, since impurities which are not intended from raw materials or the surrounding environment may be inevitably incorporated, the impurities may not be excluded. All of these impurities are not specifically mentioned in this specification, as they are known to anyone skilled in the art of steel making.

The hot-rolled steel sheet of the present disclosure, satisfying the above-described alloy composition and Relational Expression 1, includes, in detail, a tempered martensite phase as a matrix structure.

To significantly reduce the difference in hardness depending on the thickness of the steel sheet, the surface layer portion of the hot-rolled steel sheet includes, in detail, a ferrite and tempered bainite composite structure having an area fraction of 15% or more, at least one of retained austenite and tempered martensite as a remainder, and a central region excluding the surface layer portion includes, in detail, tempered martensite having an area fraction of 80% or more, at least one of retained austenite, bainite, tempered bainite, and ferrite as a remainder.

When a fraction of a composite structure of the ferrite and the tempered bainite is less than 15% in the surface layer region, the bendability is deteriorated.

In this case, the ferrite may be included in an area fraction of 5 to 20% and the tempered bainite may be included in an area fraction of 10 to 30%. More advantageously, 5 to 10% of the ferrite and 10 to 20% of the bainite may be included.

The residual structure excluding the ferrite phase and the tempered bainite phase in the surface layer region includes, in detail, at least one of retained austenite and tempered martensite and mainly includes, in further detail, tempered martensite.

In this case, it is advantageous that the tempered martensite is included in an area fraction of 50 to 85%. When the content of the tempered martensite is less than 50%, it may be difficult to secure strength. On the other hand, when the content of the tempered martensite is greater than 85%, a fraction of a soft phase is insufficient, and thus, bendability may be deteriorated.

In the present disclosure, the term "surface layer region" refers to a region from a surface layer to t/9 (where t denotes a thickness (mm)) in a thickness direction.

When the fraction of the tempered martensite phase is less than 80% in the central region, a target level of strength may not be secured, which is not preferable accordingly.

The residual structure, other than the tempered martensite phase, in the central region may include at least one of retained austenite, bainite, tempered bainite, and ferrite, but may mainly include, in detail, the tempered bainite.

In the present disclosure, the term "central region" refers to a region other than the surface layer region and may be defined as, in detail, a region from a t/4 point to a t/2 point in a thickness direction of the hot-rolled steel sheet.

As described above, in a microstructure in the surface layer region and the central region, a tempered martensite phase is formed as a matrix structure and a soft phase (ferrite+tempered bainite) is formed in the surface layer region at a constant fraction or more to cause a difference in hardness between the surface layer region and the central region.

An average hardness value of the surface layer region is preferably lower than an average hardness value of the central region by 20 to 80 Hv. More advantageously, the surface layer region may have a small hardness value of 30 to 60 Hv.

On the other hand, the central portion may have a hardness value of 300 to 400 Hv.

In addition, the hot-rolled steel sheet of the present disclosure has yield strength of 900 MPa or more, a bendability index (R/t) of 4 or less, and Charpy impact toughness of 30 J or higher at a temperature of −60° C., and thus, may secure not only high strength but also excellent bendability and low-temperature toughness.

In this case, R of the bendability index is R of a punch during 90-degree bending, and t denotes a thickness (mm) of a material.

The hot-rolled steel sheet of the present disclosure may have a thickness of 3 mm to 10 mm.

Hereinafter, a method of manufacturing a high-strength hot-rolled steel sheet having excellent bendability and low-temperature toughness, which may be another aspect of the present disclosure, will be described in detail.

A high-strength hot-rolled steel sheet according to the present disclosure may be produced by preparing a steel slab, satisfying an alloying composition proposed by the present disclosure and Relational Expression 1, and subjecting the prepared steel slab to a reheating operation, a hot-rolling operation, a cooling process, and a coiling operation and then performing a heat treatment process and a cooling process step by step.

Hereinafter, conditions of each of the processes will be described in detail below.

Steel Slab Reheating Operation

In the present disclosure, before the hot-rolling operation, a steel slab may be preferably reheated to be homogenized. In this case, the steel slab may be preferably reheated to a temperature within a range of 1200° C. to 1350° C.

When the reheating temperature is less than 1200° C., a precipitate is insufficiently solid-resolubilized, and thus, a coarse precipitate and TiN remain. On the other hand, when the reheating temperature is greater than 1350° C., strength is lowered by abnormal grain growth of austenite grains, which is not preferable accordingly.

Hot-Rolling Operation

The reheated steel slab is preferably hot-rolled to produce a hot-rolled steel sheet. In this case, the hot-rolled steel sheet is preferably subjected to a finish hot-rolling operation to a temperature within a range of 850° C. to 1150° C.

When the finish hot-rolling temperature is less than 850° C., recrystallization is excessively retarded to develop elongated grains and anisotropy is intensified to lower formability. On the other hand, when the finish hot-rolling temperature is greater than 1150° C., a temperature of the steel sheet is increased to coarsen grains and surface quality of the hot-rolled steel sheet is deteriorated.

Cooling and Coiling Operations

The hot-rolled steel sheet produced by the above-mentioned operation is preferably cooled to a temperature within a range of 500° C. to 700° C. at a cooling rate of 10° C./s to 70° C./s and is then coiled.

When a cooling termination temperature (a coiling temperature) is less than 500° C., a bainite phase and a martensite phase are locally formed to cause a material of a rolled plate to be non-uniform and a shape is deteriorated. On the other hand, when the cooling termination temperature is greater than 700° C., a coarse ferrite phase develops. In addition, when the content of a hardenable element in the steel is high, a martensite/austenite constituent (MA) structure is formed to cause a microstructure to be non-uniform.

When the cooling rate is less than 10° C./s during cooling to the above-mentioned temperature range, a cooling time to a target temperature is excessively increases and productivity is lowered. On the other hand, when the cooling rate is greater than 70° C./s, the bainite phase and the martensite phase are locally formed to cause a material to be non-uniform and to deteriorate a shape.

Stepwise Heat Treatment—Cooling

First Heat Treatment Process

A first heat treatment process is preferably performed to retain heat or to heat a coil, wound as described above, to a temperature within a range of 350° C. to 500° C. before the coil is cooled to a room temperature. In this case, the first heat treatment process preferably satisfies Relational Expression 2 below.

The first heat treatment process is a process of decarburizing a surface layer portion of the hot-rolled steel sheet. By undergoing the first treat treatment process, the content of carbon in a region having a depth of about 100 μm from a surface layer portion is decreased to 0.3 to 0.8 times, as compared with the content of carbon in a region having t/4 of a thickness of the steel sheet. In this case, a depth of a decarburized layer varies depending on a temperature, maintenance time, and alloying elements. In particular, diffusion of carbon depends on the alloying elements affecting carbon activity in the steel and formation of a carbide, such as Mn, Cr, Mo, Si, or the like.

Accordingly, in the present disclosure, the first heat treatment process is preferably controlled such that a value R1, expressed by Relational Expression 2, satisfies 78 to 85. When the value R1 is less than 78, the diffusion of carbon is not easy, and a decarburization effect is insufficient due to insufficient temperature and maintenance time. Even when the value R1 is greater than 85, the decarburized layer is no longer increased to be economically disadvantageous. This is because introduction of oxygen is limited when an oxide layer is formed on a surface layer since the wound coil has a structure in which a steel sheet is laminated, and thus, a decarburization process is gradually decreased with time due to the formation of the surface oxide layer.

Accordingly, heat preservation or heating is performed to satisfy Relational Expression 2 during the first heat treatment, which is advantageous in forming a microstructure of the surface layer portion of the hot-rolled steel sheet as a soft phase.

In the present disclosure, the first heat treatment may be performed on the coil itself wound by the previous process. In this case, the heat treatment temperature may be measured on an outer winding portion of the wound coil, for example, an outermost side of the wound coil. A method of measuring the heat treatment temperature is not necessarily limited, but a contact-type thermometer, or the like, may be used as an example.

$$R1=\mathrm{Exp}(-Q1/([T1]+273))\times(25[t']^{0.2}) \qquad \text{Relational Expression 2}$$

where Q1=450+(122[C])+(66[Mn])+(42[Cr])+(72[Mo])−(52[Si]), T1 denotes a temperature (° C.) of the outer winding portion of the coil, and t' denotes maintenance time (sec).

First Cooling Process

A first cooling process is preferably performed to cool the steel sheet at a cooling rate of 0.001° C./s to 10° C./s after the first heat treatment process is performed The first cooling can be performed as natural air cooling or forced cooling. A change in the microstructure and the decarburized layer of the surface layer portion depending on the cooling rate does not occur, but the cooling is preferably performed at a cooling rate of 0.001° C./s to 10° C./s in consideration of productivity.

Second Heat Treatment Process

Then, a second heat treatment process is preferably performed to reheat the steel sheet, cooled by the first cooling process, to a temperature within a range of 850° C. to 1000° C.

The second heat treatment process is a process of phase-transforming the microstructure of the hot-rolled steel sheet into austenite and then cooling the phase-transformed microstructure to form a martensite phase as a matrix structure. Therefore, the second heat treatment process is preferably performed to reheat the coil, cooled by the first cooling process, to a temperature within a range of 850° C. to 1000° C. after shearing the coil.

When the reheating temperature is less than 850° C., there is a ferrite phase which is not transformed into an austenite phase and is retained, and thus, strength of an end product is deteriorated. On the other hand, when the reheating temperature is greater than 1000° C., an excessively coarse austenite phase is formed to deteriorate impact resistance in a low-temperature of steel.

After the reheating to the above-mentioned temperate range, the temperature is preferably maintained for 10 to 60 minutes. When the maintenance time is less than 10 minutes, a non-transformed ferrite phase is present in a thickness center of the steel sheet, and thus, the strength is deteriorated. On the other hand, when the maintenance time is greater than 60 minutes, a coarse austenite phase is formed to deteriorate the impact resistance in a low-temperature of steel.

More preferably, the reheating temperature and the maintenance time during the second heat treatment process satisfy Relational Expression 3. Specifically, when a value R2 expressed by Relational Expression 3 is controlled under a condition satisfying 120 to 130, both target bendability and impact resistance in a low-temperature region may secured.

$$R2=\mathrm{Exp}(-Q2/([T2]+273))\times(108[t'']^{0.13}) \qquad \text{Relational Expression 3}$$

where Q2=860+(122[C])+(66[Mn])+(42[Cr])+(72[Mo])−(52[Si]), T2 denotes a temperature (° C.) of a steel plate, and t" denotes maintenance time (sec).

As the steel sheet is exposed to the atmosphere when the wound coil is sheared and reheated, an oxide layer is further formed on the decarburized layer of the surface layer portion, formed in the first heat treatment process, to perform decarburization. Accordingly, since carbon in the steel sheet is diffused, the average content of carbon in a region from the surface layer to t/9 in a thickness direction t of the steel sheet is reduced to 0.70 to 0.95 times, as compared with the average content of carbon in a region from t/4 to t/2. A ferrite phase and a bainite phase, soft phases as compared with a martensite phase, are formed in the surface layer region during a subsequent cooling process.

Second Cooling Process

A second cooling process is preferably performed to cool the steel sheet to a temperature within a range of 0° C. to 100° C. at a cooling rate of 10° C./s to 100° C./s after the second heat treatment process is performed.

During cooling after the second heat treatment process, a cooling termination temperature may be controlled to 100° C. or less to form a martensite phase, having an area fraction of 80% or more, in a central region of the hot-rolled steel sheet (in detail, a region from t/4 to t/2 in a thickness direction). Therefore, the cooling termination temperature is controlled to, in detail, 0° C. to 100° C. and, in further detail, a room temperature to 100° C. The room temperature may refer to a temperature of 15° C. to 35° C.

In addition, when the cooling rate is less than 10° C./s, it may be difficult to form a martensite phase, having an area fraction of 80% or more, in the central region. Therefore, it may be difficult to secure strength and a non-uniform structure may be formed to deteriorate the impact resistance in the low-temperature region of the steel. On the other hand, when the cooling is greater than 100° C./s, the ferrite phase and the bainite phase are insufficiently formed in the microstructure of the surface layer portion of the steel sheet to deteriorate bendability and shape quality.

Third Heat Treatment Process

Then, a third heat treatment process is preferably performed to reheat the plate material, cooled by the second cooling process, to a temperature within a range of 100° C. to 500° C.

The third heat treatment process is a tempering heat treatment process in which solid-solubilized carbon in the steel is fixed to dislocation, such that the martensite phase may be transformed into a tempered martensite phase to secure a target level of strength.

In particular, the bainite phase and the martensite phase formed in the surface layer portion are respectively formed as tempered bainite and tempered martensite to improve bending characteristics.

When the heat treatment temperature is less than 100° C., a tempering effect may not be sufficiently obtained. On the other hand, when the temperature is greater than 500° C., the strength is rapidly decreased to deteriorate ductility and impact resistance of the steel due to occurrence of the tempering brittleness.

When the heat treatment time is less than 10 minutes within the above-mentioned temperature range, the above-mentioned effect may not be sufficiently obtained. On the other hand, when the heat treatment time is greater than 60 minutes, coarse carbide is formed on the tempered martensite to deteriorate all physical properties such as strength, ductility, and low-temperature impact resistance.

Third Cooling Process

A third cooling process is preferably performed to a temperature within a range of 0° C. to 100° C. at a cooling rate of 0.001° C./s to 100° C./s after the third heat treatment process is performed.

After a tempering heat treatment is performed as described above, the steel sheet is preferably cooled to 100° C. or less to inhibit tempering brittleness. In this case, when the cooling rate is less than 0.001° C./s, the impact resistance of the steel may be deteriorated. On the other hand, when the cooling rate is greater than 100° C./s, the tempering brittleness may not be sufficiently inhibited. The third cooling process may be performed at a cooling rate of, in further detail, 0.01° C./s to 50° C./s.

Hereinafter, the present disclosure will be described in more detail with reference to Examples. It should be noted, however, that the embodiments described below are for the purpose of illustrating the present disclosure and are not intended to limit the scope of the present disclosure, since the scope of the present disclosure is determined by the matters described in the claims and matters able to be reasonably deduced therefrom.

MODE FOR INVENTION

Example

A steel slab, having an alloying composition shown in Table 1, was produced and then reheated at a temperature of 1250° C. The reheated steel slab was finish-rolled under the condition shown in Table 2 to manufacture a hot-rolled steel sheet having a thickness of about 5 mm. The hot-rolled steel sheet was cooled to a coiling temperature at a cooling rate of 30° C./s and then coiled to produce a hot-rolled coil.

Then, stepwise heat treatments (first to third heat treatments) and cooling processes (first to third cooling processes) were performed under the condition shown in Table 2 to produce a final hot-rolled steel plate. In this case, a heat preservation temperature or a heating temperature was set to a temperature of an outer winding portion of a coil during the first heat treatment, and cooling subsequent to the first heat treatment process was performed to a room temperature. In addition, a heating temperature during the second heat treatment process was set based on a surface temperature of the steel plate. After the second heat treatment process and the second cooling process were completed, the third heat treatment process was performed at a temperature of 400° C. for 10 minutes. The hot-rolled steel plate was then cooled to a temperature of 100° C. or less at an average cooling rate of 0.1° C./s.

In this case, the temperature of the outer winding portion of the wound coil refers to a temperature measured on an outermost side of the coil.

To observe a microstructure of the hot-rolled steel plate produced through the above-described processes, the hot-rolled steel plate was etched by Nital etching and was then analyzed using an optical microscope (magnification: 1000×) and a scanning electron microscope (magnification: 1000×). In this case, a retained austenite phase was measured at the magnification of 1000× using an electron backscatter diffraction (EBSD). The results are shown in Table 3.

Strength, bendability, impact resistance, and hardness of each hot-rolled steel plate were measured, and results thereof are shown in Table 4.

Yield strength (YS), tensile strength (TS), and elongation (El) refer to 0.2% offset yield strength, tensile strength, and fracture elongation, respectively. A test was performed after preparing a JIS-5 standard specimen in a direction, perpendicular to a rolling direction.

The bendability was measured by performing a 90°-bending test on the specimen, prepared in the direction perpendicular to the rolling direction, using upper molds, respectively having radius, r, of 10 mm, 12 mm, 15 mm, 17 mm, 20 mm, 22 mm, and 25 mm, to measure a minimum bending radius (r/t) at which uniformity did not occur.

The impact resistance was evaluated by measuring impact energy (Charpy V-notched energy) at a temperature of −60° C. after preparing a specimen having a thickness of 3.3 mmt. Each evaluation was performed three times, and an average value thereof was then calculated.

The hardness was calculated as an average value after measuring hardness five times in a portion from a surface layer to t/9 and a portion from t/4 to t/2 in a direction of a thickness (t, mm) of a steel sheet, and was measured through a Micro-Vickers hardness test.

TABLE 1

| | Alloying Composition (wt %) | | | | | | | | | | | | | Relational Expression |
|---|---|---|---|---|---|---|---|---|---|---|---|---|---|---|
| classification | C | Si | Mn | Cr | Al | P | S | N | Mo | Ti | Nb | V | B | 1 |
| CS1 | 0.07 | 0.2 | 0.9 | 1.1 | 0.03 | 0.009 | 0.003 | 0.004 | 0.2 | 0.02 | 0.03 | 0.005 | 0.0015 | 0.82 |
| CS2 | 0.085 | 0.3 | 1.8 | 0.3 | 0.03 | 0.007 | 0.003 | 0.003 | 0.15 | 0.015 | 0.005 | 0.01 | 0.0015 | 4.09 |
| CS3 | 0.11 | 0.45 | 0.95 | 0.6 | 0.02 | 0.006 | 0.002 | 0.004 | 0.02 | 0.02 | 0.015 | 0.005 | 0.003 | 1.88 |
| CS4 | 0.07 | 0.01 | 1.6 | 0.9 | 0.03 | 0.01 | 0.003 | 0.004 | 0.2 | 0.02 | 0.005 | 0.005 | 0.0015 | 1.63 |
| CS5 | 0.07 | 0.01 | 1.6 | 0.9 | 0.03 | 0.01 | 0.003 | 0.004 | 0.2 | 0.02 | 0.005 | 0.005 | 0.0015 | 1.63 |
| CS6 | 0.12 | 0.3 | 1.6 | 0.5 | 0.04 | 0.006 | 0.002 | 0.003 | 0.2 | 0.03 | 0.03 | 0.05 | 0.0025 | 2.46 |
| CS7 | 0.11 | 0.1 | 1.5 | 0.8 | 0.04 | 0.01 | 0.003 | 0.003 | 0.15 | 0.02 | 0.02 | 0.06 | 0.002 | 1.82 |
| CS8 | 0.12 | 0.3 | 1.8 | 0.5 | 0.03 | 0.008 | 0.003 | 0.004 | 0.2 | 0.02 | 0.001 | 0.007 | 0.0015 | 2.75 |
| IS1 | 0.07 | 0.06 | 1.5 | 0.75 | 0.03 | 0.007 | 0.003 | 0.004 | 0.01 | 0.02 | 0.05 | 0.005 | 0.002 | 2.38 |
| IS2 | 0.08 | 0.4 | 1.4 | 0.7 | 0.03 | 0.009 | 0.003 | 0.0042 | 0.2 | 0.02 | 0.02 | 0.005 | 0.0015 | 1.72 |
| IS3 | 0.11 | 0.3 | 1.35 | 0.9 | 0.03 | 0.006 | 0.003 | 0.0035 | 0.05 | 0.015 | 0.03 | 0.005 | 0.002 | 1.74 |
| IS4 | 0.085 | 0.3 | 1.25 | 0.8 | 0.03 | 0.006 | 0.003 | 0.004 | 0.15 | 0.02 | 0.025 | 0.005 | 0.002 | 1.51 |
| IS5 | 0.082 | 0.2 | 1.4 | 0.7 | 0.03 | 0.007 | 0.003 | 0.004 | 0.1 | 0.02 | 0.02 | 0.1 | 0.0018 | 2.01 |
| IS6 | 0.083 | 0.05 | 1.3 | 0.8 | 0.03 | 0.007 | 0.003 | 0.004 | 0.01 | 0.015 | 0.04 | 0.005 | 0.002 | 1.96 |
| IS7 | 0.135 | 0.1 | 1.3 | 0.9 | 0.03 | 0.006 | 0.003 | 0.003 | 0.15 | 0.02 | 0.04 | 0.004 | 0.002 | 1.49 |

IS: Inventive Steel/CS: Comparative Steel (Comparative Steels 3 and 7 are classified as comparative steels because alloying Compositions thereof satisfy the present disclosure but do not satisfy manufacturing process conditions below.)

TABLE 2

| | Finish Rolling | Coiling Temperature | First Heating and Cooling | | | Relational Expression 2 | | Second Heating and Cooling | | | Relational Expression 3 | |
|---|---|---|---|---|---|---|---|---|---|---|---|---|
| Classification | (° C.) | (° C.) | Temperature (° C.) | Maintenance Time (s) | Rate ((° C./s) | Q1 | R1 | Temperature (° C.) | Maintenance Time (s) | Rate ((° C./s) | Q2 | R2 |
| CS1 | 895 | 584 | 440 | 18000 | 0.01 | 568 | 80.0 | 900 | 2100 | 80 | 978 | 126.8 |
| CS2 | 901 | 615 | 490 | 18000 | 0.01 | 587 | 82.2 | 900 | 2400 | 80 | 997 | 127.0 |
| CS3 | 905 | 605 | 485 | 18000 | 0.01 | 529 | 88.3 | 890 | 1800 | 80 | 939 | 127.6 |
| CS4 | 899 | 585 | 380 | 18000 | 0.01 | 616 | 69.1 | 910 | 2100 | 80 | 1026 | 122.6 |
| CS5 | 889 | 580 | 430 | 18000 | 0.01 | 616 | 73.9 | 870 | 800 | 80 | 1026 | 105.0 |
| CS6 | 880 | 600 | 460 | 18000 | 0.01 | 590 | 79.3 | 875 | 600 | 80 | 1000 | 103.8 |
| CS7 | 882 | 590 | 470 | 18000 | 0.01 | 602 | 78.9 | 980 | 3000 | 80 | 1012 | 136.4 |
| CS8 | 877 | 605 | 370 | 18000 | 0.01 | 603 | 69.5 | 850 | 500 | 80 | 1013 | 98.3 |
| IS1 | 899 | 599 | 480 | 18000 | 0.01 | 587 | 81.4 | 910 | 1850 | 80 | 997 | 123.6 |
| IS2 | 900 | 582 | 480 | 18000 | 0.01 | 575 | 82.7 | 900 | 2100 | 80 | 985 | 126.1 |
| IS3 | 890 | 565 | 465 | 18000 | 0.01 | 578 | 81.1 | 880 | 2100 | 80 | 988 | 123.9 |
| IS4 | 876 | 572 | 485 | 18000 | 0.01 | 572 | 83.4 | 900 | 2400 | 80 | 982 | 128.6 |
| IS5 | 888 | 580 | 490 | 18000 | 0.01 | 579 | 83.1 | 920 | 1850 | 80 | 989 | 125.4 |
| IS6 | 881 | 594 | 464 | 18000 | 0.01 | 578 | 81.0 | 905 | 2100 | 80 | 988 | 126.2 |
| IS7 | 876 | 600 | 480 | 18000 | 0.01 | 596 | 80.4 | 890 | 2100 | 80 | 1006 | 122.9 |

IS: Inventive Steel/CS: Comparative Steel (In Table 2, R1 refers to a value of $[\mathrm{Exp}(-Q1/([T1]+273))\times(25[t']^{0.2}]$, R2 refers to a value $[\mathrm{Exp}(-Q2/([T2]+273))\times(108[t'']^{0.13}]$. Q1 denotes a value of 450+(122[C])+(66[Mn])+(42[Cr])+(72[Mo])−(52[Si]), Q2 denotes a value of [860 +(122[C])+(66 [Mn])+(42 [Cr])+(72[Mo])−(52 [Si])]. In a calculation formula of R1, T1 denotes a temperature (° C.) of an outer winding portion of a coil, t' denotes maintenance time (sec). In a calculation formula of R2, T2 denotes a surface temperature (° C.) of a steel plate.)

TABLE 3

| | Surface layer Portion (from Surface Layer to t/9) | | | Central Portion (from t/4 to t/2) | | | |
|---|---|---|---|---|---|---|---|
| Classification | T-M | F | T-B | T-M | F | T-B | R-A |
| CS 1 | 64 | 4 | 32 | 78 | 0 | 22 | 0 |
| CS 2 | 91 | 3 | 6 | 95 | 0 | 5 | 0 |
| CS 3 | 72 | 8 | 20 | 73 | 0 | 27 | 0 |

TABLE 3-continued

| | Surface layer Portion (from Surface Layer to t/9) | | | Central Portion (from t/4 to t/2) | | | |
|---|---|---|---|---|---|---|---|
| Classification | T-M | F | T-B | T-M | F | T-B | R-A |
| CS 4 | 89 | 0 | 11 | 92 | 0 | 8 | 0 |
| CS 5 | 87 | 1 | 12 | 92 | 0 | 8 | 0 |
| CS 6 | 81 | 3 | 16 | 90 | 0 | 10 | 0 |
| CS 7 | 70 | 4 | 26 | 88 | 0 | 12 | 0 |
| CS 8 | 91 | 0 | 9 | 98 | 0 | 2 | 0 |
| IS 1 | 67 | 11 | 22 | 89 | 0 | 11 | 0 |
| IS 2 | 71 | 9 | 20 | 84 | 0 | 16 | 0 |
| IS 3 | 75 | 8 | 17 | 91 | 0 | 9 | 0 |
| IS 4 | 72 | 7 | 21 | 86 | 0 | 14 | 0 |
| IS 5 | 74 | 10 | 16 | 89 | 0 | 11 | 0 |
| IS 6 | 76 | 9 | 15 | 90 | 0 | 10 | 0 |
| IS 7 | 75 | 7 | 18 | 96 | 0 | 4 | 0 |

IS: Inventive Steel/CS: Comparative Steel (In Table 3, T-M: tempered martensite, T-B: tempered bainite, F: ferrite, and R-A: retained austenite phase)

TABLE 4

| Classification | Yield Strength (MPa) | Tensile Strength (MPa) | Elongation (%) | Hardness Deviation (ΔHv) | Impact Resistance (@−60° C., J) | Bendability (r/t, 90°) |
|---|---|---|---|---|---|---|
| CS 1 | 872 | 984 | 12 | 24 | 11 | 3.5 |
| CS 2 | 915 | 1006 | 11 | 28 | 8 | 4.5 |
| CS 3 | 885 | 968 | 14 | 32 | 33 | 3 |
| CS 4 | 1010 | 1091 | 10 | 5 | 25 | 5 |
| CS 5 | 997 | 1034 | 11 | 18 | 21 | 5 |
| CS 6 | 935 | 1025 | 11 | 22 | 22 | 5 |
| CS 7 | 1015 | 1082 | 9 | 90 | 17 | 3 |
| CS 8 | 1118 | 1266 | 9 | 12 | 7 | 5.5 |
| IS 1 | 978 | 1011 | 13 | 38 | 37 | 3 |
| IS 2 | 981 | 1006 | 13 | 36 | 38 | 3 |
| IS 3 | 1080 | 1142 | 10 | 43 | 33 | 3.5 |
| IS 4 | 986 | 1030 | 13 | 39 | 34 | 3 |
| IS 5 | 992 | 1022 | 13 | 42 | 35 | 3 |
| IS 6 | 1003 | 1035 | 11 | 48 | 35 | 3 |
| IS 7 | 1160 | 1244 | 9 | 51 | 32 | 3.5 |

IS: Inventive Steel/CS: Comparative Steel (In Table 4, a hardness deviation refers to a value obtained by subtracting an average hardness value of a surface layer region (from a surface layer to a t/9 point) from an average hardness value of a central portion (from a t/4 point to a t/2 point.)

As shown in Tables 1 to 4, in each of Inventive Steels 1 to 7 satisfying both a constitutional system and manufacturing conditions, microstructures in a surface layer portion and a central portion included a tempered martensite phase as a main phase and a tempered bainite phase and a ferrite phase were formed in the surface layer portion at an appropriate fraction. Therefore, Inventive Steels 1 to 7 might satisfy all target physical properties.

Meanwhile, Comparative Steels 1 to 8, in which at least one of a constitutional system and the manufacturing conditions did not satisfy the present invention, were poor in all cases.

Specifically, in Comparative Steel 1, the content of Cr, compared with Mn, was too high to satisfy Relational Expression 1. Therefore, a tempered martensite phase was insufficiently formed in the surface portion, and a tempered bainite phase was excessively formed. As a result, target strength was not be secured, and an effect of improving impact toughness in a low-temperature region could not be obtained.

In Comparative Steel 2, the content of Mn was excessive, so that microstructural non-uniformity significantly occurred in a central portion due to segregation. Thus, impact toughness in a low-temperature region and bending properties were deteriorated.

In Comparative Steel 3, the content of Si, compared with Mn, Cr, Mo, or the like, was relatively high and did not satisfy Relational Expression 2. In Comparative Steel 3, a soft layer of a surface layer portion was well formed by diffusion of carbon and decarburization during a heat treatment, but hardenability was insufficient, and thus, a tempered martensite phase was insufficiently formed in a central portion. As a result, a target level of strength could not be secured.

Comparative Steel 4 did not satisfy Relational Expression 2 during a first heat treatment of a produced hot-rolled coil, and thus, a surface layer decarburization effect was insufficient. Accordingly, hardness of a surface portion was hardly differed from hardness of a central portion, which caused bendability to be deteriorated.

Comparative Steel 5 also did not satisfy Relational Expression 2, and thus, an initial decarburized layer was not smoothly formed. In addition, Comparative Steel 5 did not satisfy Relational Expression 3 during a second heat treatment, and thus, a ferrite phase and a tempered bainite phase were insufficiently formed in a surface layer portion, which caused impact toughness in a low-temperature region and bendability to be deteriorated.

Comparative Steel 6 deviated from Relational Expression 3, and thus, a ferrite phase was insufficiently formed in a surface layer portion, which caused impact toughness in a low-temperature region and bendability to be deteriorated.

In Comparative Steel 7, a heat treatment temperature during a second heat treatment was relatively too high to satisfy Relational Expression 3. In addition, initial austenite grains were coarsened due to an excessive heat treatment to deteriorate impact toughness in a low-temperature region.

Comparative Steel 8 did not all of Relational Expressions 1 to 3. In Comparative Steel 8, a microstructure in a central portion was non-uniform due to formation of segregation in the central portion, and fractions of a ferrite phase and a tempered bainite phase in a surface layer portion were insignificant, which caused both impact toughness in a low-temperature region and bendability to be deteriorated.

FIG. 1 is a graph showing a relationship between impact toughness in a low-temperature region and bendability of above-described Inventive Steels 1 to 7 and above-described Comparative Steels 1 to 8.

The invention claimed is:

1. A method for manufacturing a hot-rolled steel sheet, the method comprising:

reheating a steel slab to a temperature within a range of 1200° C. to 1350° C., the steel slab comprising, by weight percentage (wt %), C: 0.05 to 0.15%, Si: 0.01 to 0.5%, Mn: 0.8 to 1.5%, Al: 0.01 to 0.1%, Cr: 0.3 to 1.2%, Mo: 0.001 to 0.5%, P: 0.001 to 0.01%, S: 0.001 to 0.01%, N: 0.001 to 0.01%, Nb: 0.001 to 0.06%, Ti: 0.005 to 0.03%, V: 0.001 to 0.2%, B: 0.0003 to 0.003%, a remainder of iron (Fe), and other unavoidable impurities, wherein a content relationship (T) of C, Mn, Cr, and Mo, expressed by Relational Expression 1 below, satisfies 1.0 to 2.5;

finish hot rolling the reheated steel slab to a temperature within a range of 850° C. to 1150° C. to manufacture a hot-rolled steel sheet;

cooling the hot-rolled steel sheet to a temperature within a range of 500° C. to 700° C. at a cooling rate of 10° C./s to 70° C./s after the finish hot rolling;

coiling the hot-rolled steel sheet within a temperature range of 500° C. to 700° C. after the cooling;

performing a first heat treatment to preserve heat of the hot-rolled steel sheet or to heat the hot-rolled steel sheet within a temperature range of 350° C. to 500° C. after the coiling;

performing first cooling to cool the hot-rolled steel sheet to a room temperature at a cooling rate of 0.001° C./s to 10° C./s after the first heat treatment;

performing a second heat treatment to reheat the hot-rolled steel sheet to a temperature within a range of 850° C. to 1000° C. and to maintain the reheated hot-rolled steel sheet for 10 minutes to 60 minutes after the first cooling;

performing second cooling to cool the hot-rolled steel sheet to a temperature within a range of 0° C. to 100° C. at a cooling rate of 10° C./s to 100° C./s after the second heat treatment;

performing a third heat treatment to reheat the hot-rolled steel sheet to a temperature within a range of 100° C. to 500° C. and to thermally treat the reheated hot-rolled steel sheet for 10 minutes to 60 minutes after the second cooling; and performing third cooling to cool the hot-rolled steel sheet to a temperature within a range of 0° C. to 100° C. at a cooling rate of 0.001° C./s to 100° C./s after the third heat treatment, $$T=[C]+\{[Mn]/(0.85[Cr]+1.3[Mo])\} \quad \text{Relational Expression 1:}$$

where C, Mn, Cr, and Mo refer to weight contents of elements, respectively.

2. The method of claim 1, wherein the first heat treatment is performed under a condition in which a value R1, expressed by Relational Expression 2 below, satisfies 78 to 85, $$R1=\mathrm{Exp}(-Q1/([T1]+273))\times(25[t']^{0.2}) \quad \text{Relational Expression 2:}$$

where Q1=450+(122[C])+(66[Mn])+(42[Cr])+(72[Mo])−(52[Si]), T1 denotes a temperature (° C.) of the outer winding portion of the coil, and t' denotes maintenance time (sec).

3. The method of claim 1, wherein the second heat treatment is performed under a condition in which a value R2, expressed by Relational Expression 3 below, satisfies 120 to 130, $$R2=\mathrm{Exp}(-Q2/([T2]+273))\times(108[t'']^{0.13}) \quad \text{Relational Expression 3:}$$

where Q2=860+(122[C])+(66[Mn])+(42[Cr])+(72[Mo])−(52[Si]), T2 denotes a surface temperature (° C.) of a steel plate, and t" denotes maintenance time (sec).

* * * * *